US008356995B2

(12) United States Patent
Lvovskiy et al.

(10) Patent No.: US 8,356,995 B2
(45) Date of Patent: Jan. 22, 2013

(54) RECOIL EMULATION DEVICE FOR WEAPON TRAINING

(76) Inventors: Matvey Lvovskiy, Brooklyn, NY (US); Ilya Lipkind, Campbell, CA (US)

( * ) Notice: Subject to any disclaimer, the term of this patent is extended or adjusted under 35 U.S.C. 154(b) by 1242 days.

(21) Appl. No.: 12/011,168

(22) Filed: Apr. 25, 2008

(65) Prior Publication Data

US 2012/0148989 A1 Jun. 14, 2012

(51) Int. Cl.
*F41A 33/00* (2006.01)

(52) U.S. Cl. ..... 434/18; 434/11

(58) Field of Classification Search ..... 434/11–27; 42/27; 446/406; 463/49
See application file for complete search history.

(56) References Cited

U.S. PATENT DOCUMENTS 4,302,190 A * 11/1981 Shaw et al. ..... 434/18
4,480,999 A * 11/1984 Witherell et al. ..... 434/18
6,820,608 B2 * 11/2004 Schavone ..... 124/74

* cited by examiner

*Primary Examiner* — Timothy A Musselman

(57) ABSTRACT

The present invention relates generally to devices that are used to simulate a firearm recoil effect. It is a known fact that the recoil effect of a firearm directly influences quality of marksmanship of a shooter in areas including but not limited to target acquisition and re-acquisition, firing accuracy, psychological anticipation of a shot to be fired, proper grip of a weapon and more. The suggested device is used in a combination with training simulators to enhance the tactical functionality and by so increasing the quality of training. The recoil emulation device mounts on a barrel of any standard handheld firearm including but not limited to all types of machine guns and sniper rifles. It is then connected via a cable to an air compressor, which provides air pressure required to initiate a recoil emulation cycle. The recoil emulation device consists of a cylinder, which holds a metal ball, which travels throughout the cylinder and provides the impact required to cause an upward displacement of a weapon.

11 Claims, 2 Drawing Sheets

RECOIL EMULATION DEVICE FOR WEAPON TRAINING

BACKGROUND OF THE INVENTION

The proposed device falls into category of devices that imitate recoil shock that takes place during a firearm shot. It is known, that when shooting a typical rifle the operator experiences strong blows into his shoulder. Recoil causes a certain tension and constrains the shooter somewhat, which in turn affect the targeting ability of the shooter. Essentially every new shot requires re-targeting.

For acquiring weapon usage skills a shooting training is essential. Various training simulators that are used for this purpose allow practicing sharp shooting from any type of light firearms without using live ammunition. "Training Simulator For Sharp Shooting" (U.S. Pat. No. 6,942,486 and one with filing number U.S. Ser. No. 11/274,904 both issued to Matvey Lvovskiy) falls into this class. The last filing introduces a technical concept of building a simulator based on using real (but not loaded) weapons systems. In those training systems the image of the target shown on the screen, while shots are emulated by sending a laser beam from the emitter that is attached to the firearm and is activated by pulling on the trigger. To make training exercises more effective and to assist in development of recoil management and target re-acquisition skills we propose an additional device to emulate, the recoil effect.

Analysis shows a large number of patented devices in this area. In the Pat. No. 4,380,437 the recoil emulation device is installed into a model rifle approximating the shape of the weapon, rather than a real weapon itself. When the trigger is pulled a pneumatic system is activated, which rapidly propels an auxiliary bottom of the butt of the rifle in the direction of the shooter imitating the recoil effect. This approach leads to the phenomenon of varying distance between the shoulder and the butt of the weapon during the time interval between the shot and the recoil. When using a real weapon this phenomenon does not take place. Therefore this approach has a limited application and is not usable as an attachment to the real weapon systems that are used during training exercises. The Pat. Nos. 6,729,322 and 6,869,285 for teaching and training devices also use model rather then real rifles. Practically every weapon type requires a modification of the recoil emulation system.

SUMMARY OF THE INVENTION

The idea behind the operation of the proposed device is in the use of a directed mechanical strike into the specific point on the outside of the weapon frame. As a result, an effect that very closely resembles recoil of the weapon during a live ammunition shot gets created. This effect is created using an object called striker, which has a shape of either a ball or a cylinder of a specific mass, fitted into an enclosing cylinder. The cylinder attaches to the weapon and through a two way valve with an electro-magnetic control is connected to a high air pressure tube. When the trigger is pulled and a connected contractor is activated, the two-way valve receives an electrical signal. After the valve is turned on the high-pressure air starts flowing into the inside of the cylinder through a hole in its bottom. The striker initially located in the bottom part of the cylinder starts to move under the mounting air pressure, gaining kinetic energy in the process. At the moment the striker reaches the top part of the cylinder, which is rigidly connected to the weapon frame, an impact occurs, which propels the weapon from the initial state and the shooter experiences a force strike with his arms and shoulder.

The recoil emulation device has a way to return the striker into its original state after each shot. To reduce the time it takes to return the striker, the design layout of the device has a solenoid with an electrical layout of its operation. To provide comfortable conditions during training, an approach has been developed to minimize the effect of the elements related to the pressurized airflow.

The connectors that attach the recoil emulation device are included in the overall package. Because of this, no modification to the original rifle is required and none of its technical characteristics are affected. The proposed device also does not impede the attachment of the laser emitter and trigger connector used in our other patent for target shooting. When both of those attachments are removed the rifle can again be used with live ammunition.

The recoil emulation device is meant to be used with all types of unloaded firearms (automatic and sniper rifles, grenade launchers, hunting rifles) without caliber limitation.

BRIEF DESCRIPTION OF THE DRAWINGS

A detailed description of the present invention follows with reference to the accompanying drawings in which like elements are indicated by like references and numerals.

Figure 4:
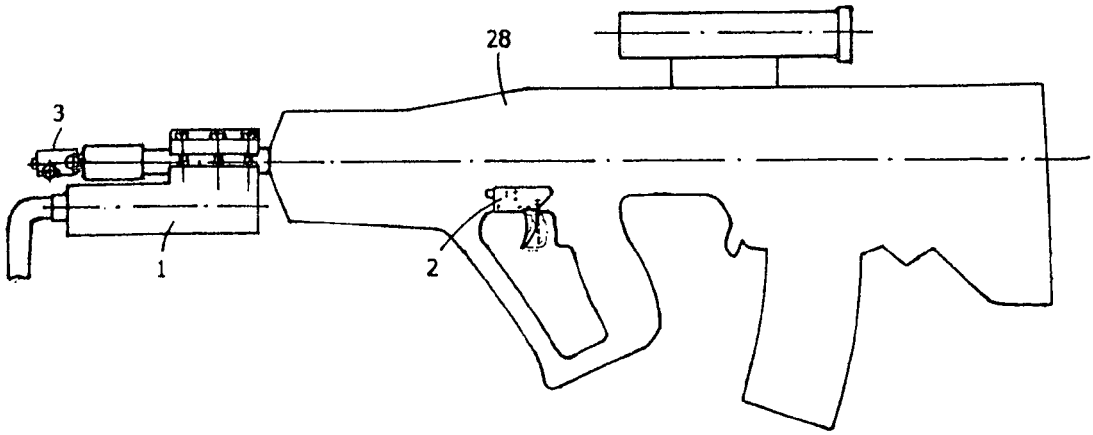

On FIG. 4 a placement of the device on the sniper rifle is shown together with the laser targeting attachment.

Figure 1:
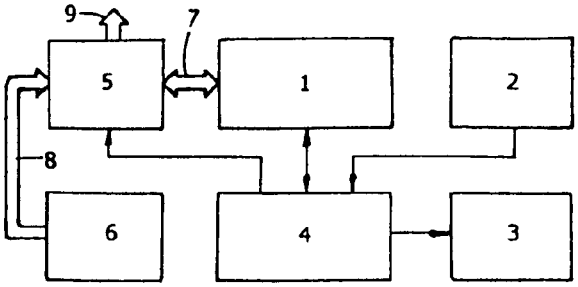
FIG. 1 shows a structural diagram of the recoil imitation device designed for usage with various types of rifles (automatic and sniper).

FIG. 1 shows a structural diagram of the device. The device consists of two functionally related components: an initiator of a force impulse 1, attached to the hull of the gun, contactor 2 and laser emitter 3, also attached to the weapon, electronics block 4, two-way valve 5, a compressor 6, a flexible hose 7 and stationary air pipe. Upon the pulling of the trigger a contactor 2 sends a command signal into electronics-block 4, which in turn turns on laser emitter 3, which forms the impulse for the laser beam that imitates the shot. At the same time, the two-way air valve gets activated, connecting the initiator of a force impulse 1 through the flexible hose 7 and stationary air pipe to the compressor 6, while simultaneously sealing the passage between initiator 1 and the external environment.

A tank with the compressed air with an attached controller for managing air pressure can be used instead of the compressor. Initiator 1 acts to transform the air pressure into kinetic energy, which in turn gets transformed into a force of a directed blow. In this particular case, i.e. for rifles, the force vector used to imitate the recoil effect is directed either parallel or at a slight angle to the axis of the barrel (in case of the short barrel riles). A directed impulse is felt by the shooter as a blow to the. After the shot, an initiator 1 generates a signal that returns the device into its initial state.

Figure 2:
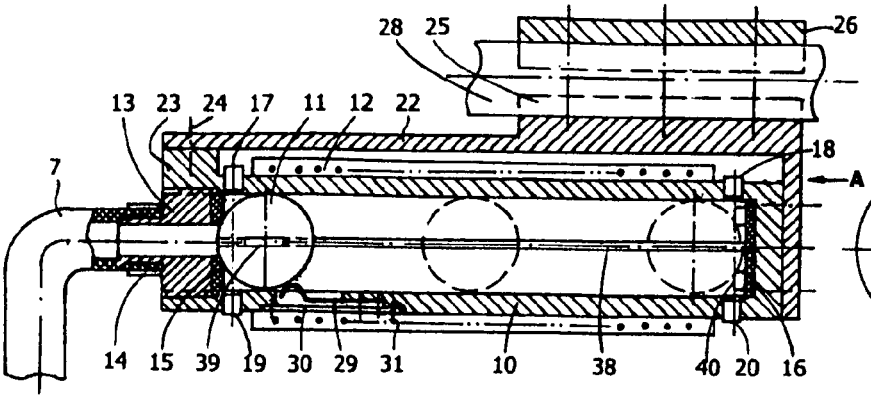
FIG. 2 and FIG. 2A show an assembly diagram of the striker together with the components for its attachment to the rifle.
Figure 2A:
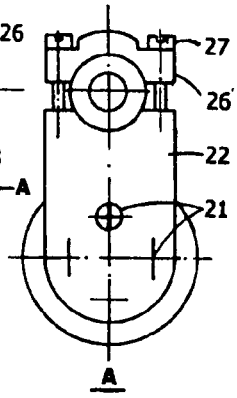

FIG. 2 and FIG. 2A is an assembly diagram of the initiator of a force impulse 1, which is meant to attach to the barrel of the firearm (for example a sniper rifle). The initiator can be installed parallel to the axis of the barrel or under a slight angle to it in a case of a short barrel rifle. Initiator of the force impulse 1, consists of a hull 10, made out of a strong non-magnetic alloy, inside of which is shaped as a hollow cylinder and containing a striker 11 (instead of a ball shown on FIG. 2, an object of cylindrical shape can be used). The striker 11 is magnetized in a specific way. For a consistent orientation of the ball during its movement inside the cylinder two slides 38 are made to fit into corresponding parallel groves 39 on the ball 11. A solenoid 12 is fitted onto the hull 10. The usage of a low powered solenoid that ads insignificant weight to the device is a preferred for the horizontal attachment of the device, because it guarantees the return of the striker onto its initial state under any conditions, for example during target practice involving targets located above the horizontal line drawn through the eyes of the shooter. Coupling 13 is screwed the hull of the device and the flexible hose 7 is put onto the coupling. The hose is strongly attached to the coupling 13, using a spring socket 14. A pad 15 made from phtoroplast or similar material is attached to the inner side of the coupling 13, which prevents a direct contact between the striker and the coupling to avoid any damage to the components. Soundproof pad 16 is attached on the other side of the inner part of the hull to lower the level of the sound that the striker produces when it hits the metal hull.

LEDs 17 and 18 are located close to the ends of he solenoid from two sides of the hull. Photodiodes 19 and 20 are located symmetrically on the other side of the hull. Therefore each pair of photo and light emitting diodes is located on the same optical axis. At the endpoints of its trajectory, the striker crosses the optical axis of the described diode pairs.

To attach the recoil emulation device to the barrel of the gun, on the hull TO of the initiator 1 there is an bracket 22 that is attached using screws 21, the other end of which is attached on the protrusion 23 of the hull 10 using screws 24. The initiator 1 is strongly attached to the barrel 28 using bracket 22 that has a directing cylindrical groove 25, onlay 26 which also has a cylindrical shape and screws 27 that are located along the flanges on both sides of the onlay.

A spring 29 is attached to the hull with screws 31 in order to prevent the rebound of the striker during its return to the initial state and fixing it in that position.

Figure 3:
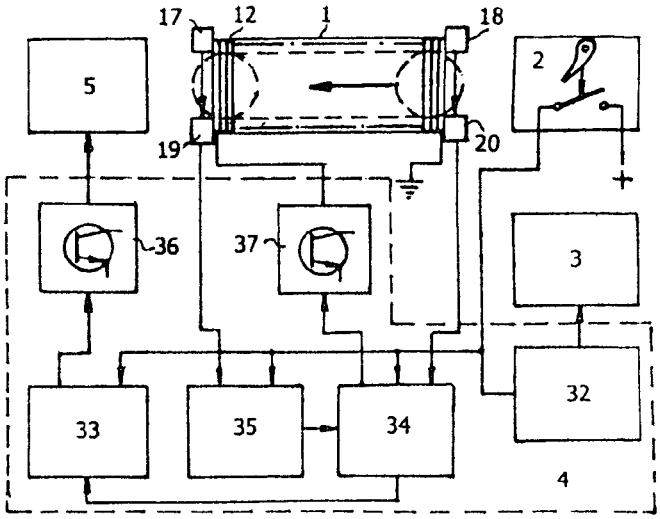
FIG. 3 shows an electrical layout diagram of the recoil emulation device.

FIG. 3 shows an electrical circuit of the device. It includes the following connected components: solenoid 12, contactor 2, containing a micro-switch, that gets activated by pulling the weapon's trigger, a two-way valve with electromagnetic control 5, emitter device 3, LEDs 17 and 18, photodiodes 19 and 20, electronics block 4 that includes first timer 34, second timer 35, third timer 33, power source 32 designed for laser diode of the emitter and two current amplifiers 36 and 37. Solenoid 12 is connected through an amplifier 37 to the output of the first timer 34, first and second inputs of which are connected to contactor 2 and photo diode 19 respectively, and the output of which is connected to the input of the third input of the timer 34. First input of the timer 33 is connected to the contactor 2, first output of the timer 33 is connected, through the amplifier 36 to the two-way valve 5; second output of the timer 33 is connected to the third input of the timer 34. Second input of the timer 33 is connected with the second output of the timer 34.

FIG. 4 shows the location of the striker 1, contactor 2 and laser emitting device 3 on the sniper rifle 28. Installation and attachment of these components to the rifles does not require any special tools. Upon the removal of the devices 1,2 and 3 from the firearm, the firearm is ready for combat use. The other components of the recoil device: electronics block 4, two-way valve and the compressor are stationary and are installed close to the shooter's position. The communication between the components installed on the rifle and the electronics block 4, happens through a flexible electrical cable.

Recoil imitation device is designed for installation on various rifle types and is shown on FIG. 1, FIG. 2, FIG. 3 and FIG. 4 and works as follows: upon pulling of the firearm's trigger micro-switch of the contactor 2 is activated. The command signal from the contactor is sent to the input of the power source 32, that is part of electronics block 4. Power source generates a current that arrives to the laser diode of the emitter device 3. Laser diode generates a laser beam directed on to the target screen. Thus a rifle shot is emulated.

Simultaneously a command signal from the contactor is sent to the first inputs of the timers 33, 34 and 35. Upon the arrival of the signal timers 34 and 35 are initialized and transitioned to the wait state. Upon the arrival of the command signal to the timer 33, it forms a rectangular signal of length $\tau_1$, which is sent to the input of the amplifier 36. The amplifier turns on the electromagnetic control of a two-way valve 5, which seals the opening to the outside and opens an air passage through which the high pressure the air arrives into the inside of the cylinder 10 through the flexible hose 7 and the tube from compressor 6 (or air pressurized air tank). Under the pressure from the air, the striker 11 accelerates and gains kinetic energy that upon contact with the opposite end of the cylinder gets converted into the force of the strike. The force of the strike through installation elements 22, 26 and 27 is transferred to the weapon 28, so that the recoil effect that occurs during combat is simulated. During the movement of the striker under air pressure, the air in front of the striker escapes through the hole 40.

During its trajectory, and just before the impact, the striker 11 crosses the light beam emitted form the LED 18 and which is received by the photodiode 20. The disappearance of the light beam from the photo diode results in activation of the timer 34, which in turn (with small delay) triggers two events:

- Upon the signal form the second output of the timer 34, which arrives to the second input of the timer 33 the amplifier 36 gets turned on and the two-way valve is returned to the original state in which the inner part of the hull becomes exposed to the outside air
- Upon the signal of timer 24 the amplifier 37 gets turned on and direct current gets sent into the solenoid shell, which creates a magnetic field, with induction M and voltage H of which is directed along tea xi of the solenoid. Because of this the magnetized striker will be attracted back to its initial sate with a certain velocity, which depends on the current strength and can be regulated.

The trajectory of the ball during its return to the initial state crosses the light beam from LED 17, which is received by the photodiode 19. The disappearance of the light beam from the photo diode results in activation of the timer 35, which in turn (with small delay) turns on amplifier 37 and results in the disappearance of the magnetic field inducted inside the solenoid. The spring 29 reduced the probability of the rebound of the striker during its return to the initial state and stabilizes striker in that state. After the return of the striker to its initial state the recoil emulation device is ready for the next shot.

To decrease the delay of the recoil due to the time it takes to fill the hose with compressed air and to minimize the additional recoil due to the action of the compressed air on the end of the hose 7 (FIG. 2) attached to the cylinder 10, valve 5 attaches either directly to the initiator 1, i.e. on the weapon, or at the minimal distance from it. In the later case, two-way valve attaches to the wall, that separates the shooters or to the table that supports the elbows during firing of the firearm. In this case the length of the hose should be minimally sufficient for a comfortable use of the weapon.

Advantages of the Invention

The recoil emulation device produces the simulated recoil effect during the practice of target shooting from firearms without using live ammunition that approaches the recoil effect when live ammunition is used.

The suggested technical solutions allow for the return of the striker back to its original state after the shot, creating necessary conditions for the next shot and its recoil emulation.

The assembly of the recoil emulation device and the ways to attach it to the weapon allow for its usage with all types of light firearms (sniper rifles, machine guns, etc) in use in the army, police and various special forces units, for target practice without live ammunition. The device also does not require any modification to the weapon systems. When the device components are removed from the firearm, the firearm is immediately ready for the combat use.

The design, schematic and construction solutions taken in the described recoil emulation device allow to adapt it to the majority of modern training systems for target shooting practice for all types of light weapons. Emulation of the recoil effect, which simulates real recoil from live ammunition, will raise the effectiveness of the target shooting practice on the training system.

What is claimed is:

1. A recoil emulation device comprising in combination:

a force impulse initiator having a striker, an intake port, an inner chamber;

compressor means having an output port for providing a stream of compressed air;

a two way valve means having an intake port connected to the output port of said compressor means, and an output port connected to an intake port of said force impulse initiator;

a block of electronics attachable to a real weapon and mechanically connected to a trigger designed to form and send commands to activate said force impulse initiator and control said two way air valve, wherein said force impulse initiator initiates a recoil strike into a shoulder of a shooter by means of contained within it an unbound projectile of finite mass propelled by compressed air along an axis parallel to or at a slight angle to an axis of a barrel of a weapon;

a contactor means of connecting said block of electronics to a weapon trigger.

2. The Recoil Emulation Device according to claim 1, wherein the force strike initiator consists of a body containing elements for rigid attachment to a weapon; a cylindrical inner chamber with a wall facing a shooter having a sound absorbent pad with air escape holes and an opposite wall having a screwed in coupling for admitting a controlled amount of compressed air; a striker in a form of a ball or a small cylinder placed inside a chamber with a minimal clearance and a specific mass.

3. The Recoil Emulation Device according to claim 1, wherein the force impulse initiator contains a solenoid placed on its hull that under a current of a specific polarity ensures a rapid return of the striker to its initial state.

4. The Recoil Emulation Device according to claim 1, wherein the hull of said force impulse initiator is made of non-magnetic alloy.

5. The Recoil Emulation Device according to claim 1, wherein the striker in the force impulse initiator is magnetized in a specific way.

6. The Recoil Emulation Device according to claim 1, wherein the inner chamber of the force impulse initiator has two symmetric slides while the spherically shaped striker has two matching grooves to fix its orientation.

7. The Recoil Emulation Device according to claim 1, wherein a body of the force impulse initiator contains an LED and a photodiode situated directly across from each other between the end of the solenoid and the sound absorbent pad in such a way that the striker blocks the light from the LED at a moment of time just before it strikes a wall of the inner chamber.

8. The Recoil Emulation Device according to claim 1, wherein a body of the force impulse initiator contains an LED and a photodiode situated directly across from each other between an end of the solenoid and coupling in such a way that the striker blocks the light from the LED at a moment when it reaches its initial state.

9. The Recoil Emulation Device according to claim 1, wherein said force impulse initiator contains a spring attached to an outer side of its hull with a ledge at an end of said spring; wherein said ledge is placed inside a hole in a hull and protrudes outside the inner cylindrical surface of the hull while the hole and the spring are sealed by an air tight cover.

10. The Recoil Emulation Device according to claim 1, wherein said block of electronics is effectively connected to said contactor means and two way valve means and comprises:

a first timer;

a second timer;

a third timer;

a first current amplifier connected to said solenoid;

a second current amplifier connected to said two way valve;

a power source connected to said LEDs.

11. The Recoil Emulation Device according to claim 1, further characterized by an attachment means comprising:

a bracket with one end attached to outer end of the hull, while the other end is attached to a protrusion, located on the opposite side of the hull and said bracket having a shortened cylindrical couch with depressions of cylindrical shape for attaching to a barrel of a weapon, and screw holes on longitudinal sides;

a pad of cylindrical shape;

a screw means for pulling together longitudinal flanges of said bracket and said pad attaching said force impulse initiator on a weapon barrel.

* * * * *